US008366334B2

(12) United States Patent
Kitabatake

(10) Patent No.: US 8,366,334 B2
(45) Date of Patent: Feb. 5, 2013

(54) IMPACT HEAD AND PRINTING APPARATUS

(75) Inventor: Tetsuya Kitabatake, Tokyo (JP)

(73) Assignee: Oki Data Corporation, Tokyo (JP)

( * ) Notice: Subject to any disclaimer, the term of this patent is extended or adjusted under 35 U.S.C. 154(b) by 879 days.

(21) Appl. No.: 12/379,339

(22) Filed: Feb. 19, 2009

(65) Prior Publication Data

US 2009/0245909 A1 Oct. 1, 2009

(30) Foreign Application Priority Data

Mar. 28, 2008 (JP) ..... 2008-086481

(51) Int. Cl.
*B41J 2/24* (2006.01)

(52) U.S. Cl. ..... 400/124.21; 400/105

(58) Field of Classification Search ..... 400/105, 400/124.21

See application file for complete search history.

(56) References Cited

U.S. PATENT DOCUMENTS 6,503,007 B1 * 1/2003 Furrow et al. ..... 400/208

* cited by examiner

*Primary Examiner* — Michael G Lee
*Assistant Examiner* — Matthew Mikels
(74) *Attorney, Agent, or Firm* — Kubotera & Associates, LLC

(57) ABSTRACT

An impact head includes an arm member moving to a protruding position when a magnetic flux is generated and to a return position when the magnetic flux disappears; an impact member connected to the arm member for protruding when the arm member moves to the protruding position and returning to an original position when the arm member moves to the return position; and an urging member for urging the arm member with a restricted urging force when the magnetic flux is generated and urging the arm member to the return position when the magnetic flux disappears.

4 Claims, 20 Drawing Sheets

IMPACT HEAD AND PRINTING APPARATUS

BACKGROUND OF THE INVENTION AND RELATED ART STATEMENT

The present invention relates to an impact head and a printing apparatus such as an impact printer.

A conventional impact printer includes an impact head having a magnetic circuit formed of a york and an armature. In the impact head, the armature rotates to drive a print wire, so that the print wire hits a printing surface through an ink ribbon, thereby performing a printing operation (refer to Patent Reference).

Patent Reference: Japan Patent Publication No. 2806871

FIG. 13 is a schematic perspective view showing a conventional impact head 24' of a clapper type for one pin. FIG. 14 is a schematic side view showing the conventional impact head 24'. FIG. 15 is an enlarged perspective view showing a core 3' of the conventional impact head 24'. In a case of a 24-pin head, the structure shown in FIG. 13 is arranged on 24 locations in a circle shape.

As shown in FIGS. 13 and 14, the core 3' is formed of a magnetic material, and an armature york 6' and a core york 7' are laminated and fixed on an outer circumference of the core 3'. As shown in FIG. 15, the core 3' further includes a protruding portion F' for attracting an armature 1'. The armature 1' includes a protruding portion E' at a lower portion thereof to face the protruding portion F' of the core 3'.

A coil 4' is disposed around the protruding portion F' of the core 3', and a control unit (not shown) applies a current to the coil 4'. A wire 2' is fixed to a distal end portion of the armature 1' through welding and the likes. A circular portion A' is formed at a rear end portion of the armature 1' as a rotational pivot.

A spring plate 8' formed of an elastic member such as a plate spring urges the armature 1' at a rear end portion thereof. Accordingly, the circular portion A' formed at the rear end portion of the armature 1' is pressed against the armature york 6' and the core york 7' in an arrow direction b, thereby functioning as the rotational pivot of the armature 1'.

The spring plate 8' is fixed to a side of a head cover (not shown). A groove portion D' is formed in a guide holder 9' for guiding the distal end portion of the armature 1' in the left to right direction to be movable in the vertical direction. A reset spring 5' is disposed in a hole formed in a bottom surface of the groove portion D' of the guide holder 9'.

The reset spring 5' is formed of an urging member such as a coil spring. When the armature 1' is set in the groove portion D' of the guide holder 9', the reset spring 5' lifts the armature 1' toward an upper surface of the core 3' (in a reset direction). It is configured that the armature 1 moves to impact toward a bottom surface of the core 3' (in an impact direction) against the urging force of the reset spring 5'.

FIG. 16 is a schematic view No. 1 showing an operation of the conventional impact head 24'. FIG. 17 is a schematic view No. 2 showing the operation of the conventional impact head 24'. FIG. 16 is a view showing a reset state, and FIG. 17 is a view showing an impact state.

As shown in FIG. 16, in the reset state, the armature 1' is pressed with the spring plate 8' in the arrow direction b with the circular portion A' as the rotational pivot. Further, the reset spring 5' urges the armature 1' in the reset direction. The spring plate 8' has a portion C', so that the protruding portion E' of the armature 1' is separated from the protruding portion F' of the core 3' by a distance Δx while the reset spring 5' lifts the armature 1' upwardly.

As shown in FIG. 17, in the impact state, the control unit (not shown) applies a current to the coil 4' to generate a magnetic flux, so that the armature 1' is attracted in the impact direction against the urging force of the reset spring 5'. Accordingly, the wire 2' at the distal end portion of the armature 1' moves in the impact direction while the circular portion A' functions as the rotational pivot, thereby applying an impact.

FIG. 18 is a graph showing a current Ia applied to the conventional impact head 24' and an armature force f1 thus generated. As shown in FIG. 18, the current Ia is applied to the coil 4' at a timing (t=0), and is turned off when the wire 2' reaches an impact point. When the current Ia is applied, the armature force f1 is generated for attracting the armature 1' in the impact direction. An urging force Qf2 is applied to the armature 1' in the reset direction, and a drive force Qf3 is a combinational force of the armature force f1 and the urging force Gf2.

In the reset state shown in FIG. 16, that is, before the timing (t=0), the armature 1' is lifted with the reset spring 5' in the reset direction through the urging force Qf2. When the current Ia is applied to the coil 4' for the impact operation, the armature force f1 is generated to move the armature 1' in the impact direction.

When an initial operation time T0 passes after the current Ia is applied at the timing (t=0), the armature force f1 balances with the urging force Qf2, and then the armature force f1 exceeds the urging force Qf2, thereby rotating the armature 1' in the impact direction. When an impact time QTimp passes after the current Ia is applied at the timing (t=0), the armature 1' reaches the impact position, thereby becoming the impact state shown in FIG. 17.

When the current Ia is turned off, the armature force f1 disappears, so that the armature 1' returns in the reset direction with the urging force of the reset spring 5'. When a reset time QTres passes after the current Ia is turned off, the armature 1' returns to the reset state shown in FIG. 16. The impact time QTimp and the reset time QTres represent a cycle time QTc of one pin. When the cycle time QTc becomes shorter, it is possible to perform the printing operation at a higher speed.

In order to shorten the cycle time QTc and perform the printing operation at a high speed, it is necessary to shorten both the impact time QTimp and the reset time QTres constituting the cycle time QTc.

In the conventional impact head 24' of the clapper type described above, when the urging force Qf2 of the set spring 5' decreases and the drive force Qf3 increases, the armature 1' performs the impact operation in a shorter period of time. Accordingly, it is possible to decrease the initial operation time T0 and the impact time QTimp. In this case, however, the armature 1' returns with the urging force Qf2 of the set spring 5', thereby increasing the reset time QTres. Accordingly, it is difficult to shorten the cycle time Qtc after all.

When the urging force Qf2 of the set spring 5' increases, on the other hand, it is possible to shorten the reset time QTres. However, the drive force Qf3 decreases, thereby increasing the initial operation time T0. As a result, the impact time QTimp increases, thereby increasing or making no change in the cycle time Qtc.

In view of the problems described above, an object of the present invention is to provide an impact head capable of solving the problems of the conventional impact head Further objects and advantages of the invention will be apparent from the following description of the invention.

SUMMARY OF THE INVENTION

According to an aspect of the present invention, an impact head includes an arm member moving to a protruding position when a magnetic flux is generated and to a return position when the magnetic flux disappears; an impact member connected to the arm member for protruding when the arm member moves to the protruding position and returning to an original position when the arm member moves to the return position; and an urging member for urging the arm member with a restricted urging force when the magnetic flux is generated and urging the arm member to the return position when the magnetic flux disappears.

In the aspect of the present invention, the impact head includes the arm member moving to the protruding position when the magnetic flux is generated and to the return position when the magnetic flux disappears; the impact member connected to the arm member for protruding when the arm member moves to the protruding position and returning to the original position when the arm member moves to the return position; and the urging member for urging the arm member with the restricted urging force when the magnetic flux is generated and urging the arm member to the return position when the magnetic flux disappears. Accordingly, it is possible to shorten both an impact time and a reset time, thereby shortening a cycle time and performing a printing operation at a high speed.

DETAILED DESCRIPTION OF THE PREFERRED EMBODIMENTS

Figure 1:
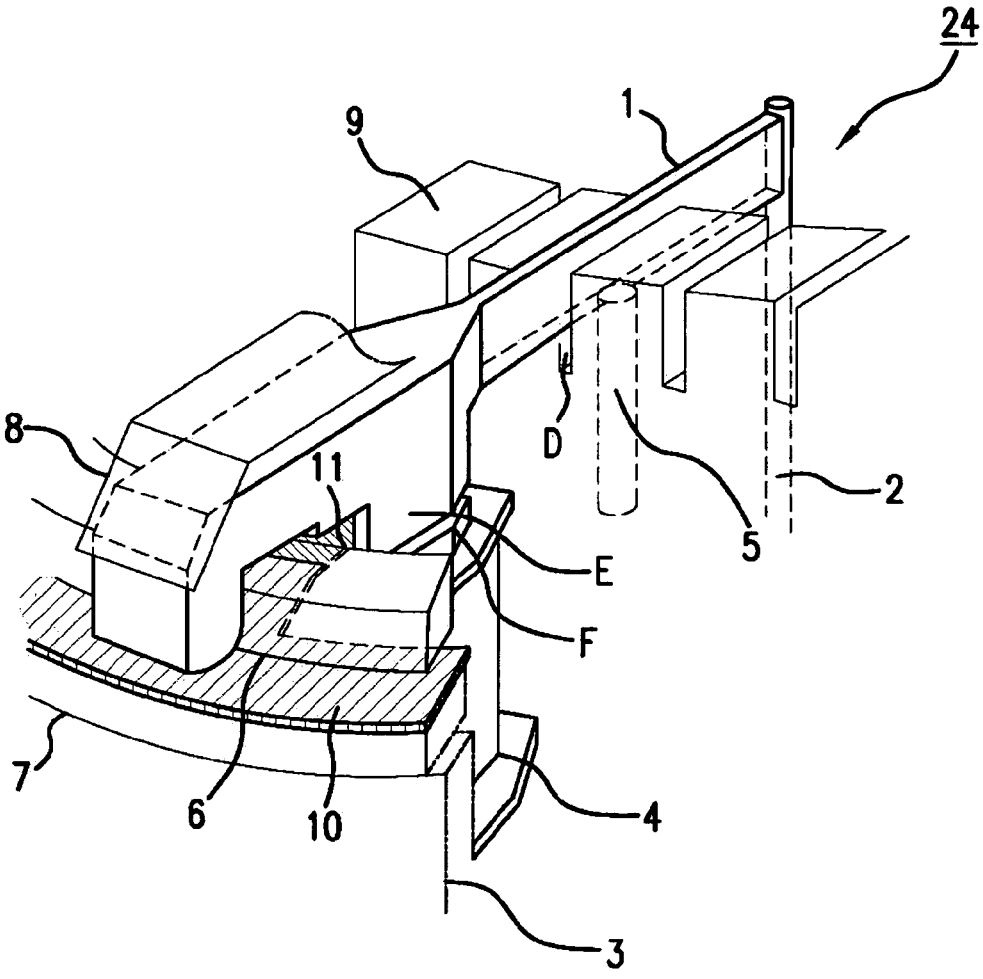
FIG. 1 is a schematic perspective view showing an impact head according to a first embodiment of the present invention.

Hereunder, embodiments of the present invention will be described in detail with reference to the accompanying drawings. In the drawings and the following description, similar components are designated with the same reference numerals. An impact printer will be explained as a printing apparatus, and the present invention is not limited thereto.

First Embodiment

A first embodiment of the present invention will be explained with reference to FIGS. 19 and 20.

Figure 19:
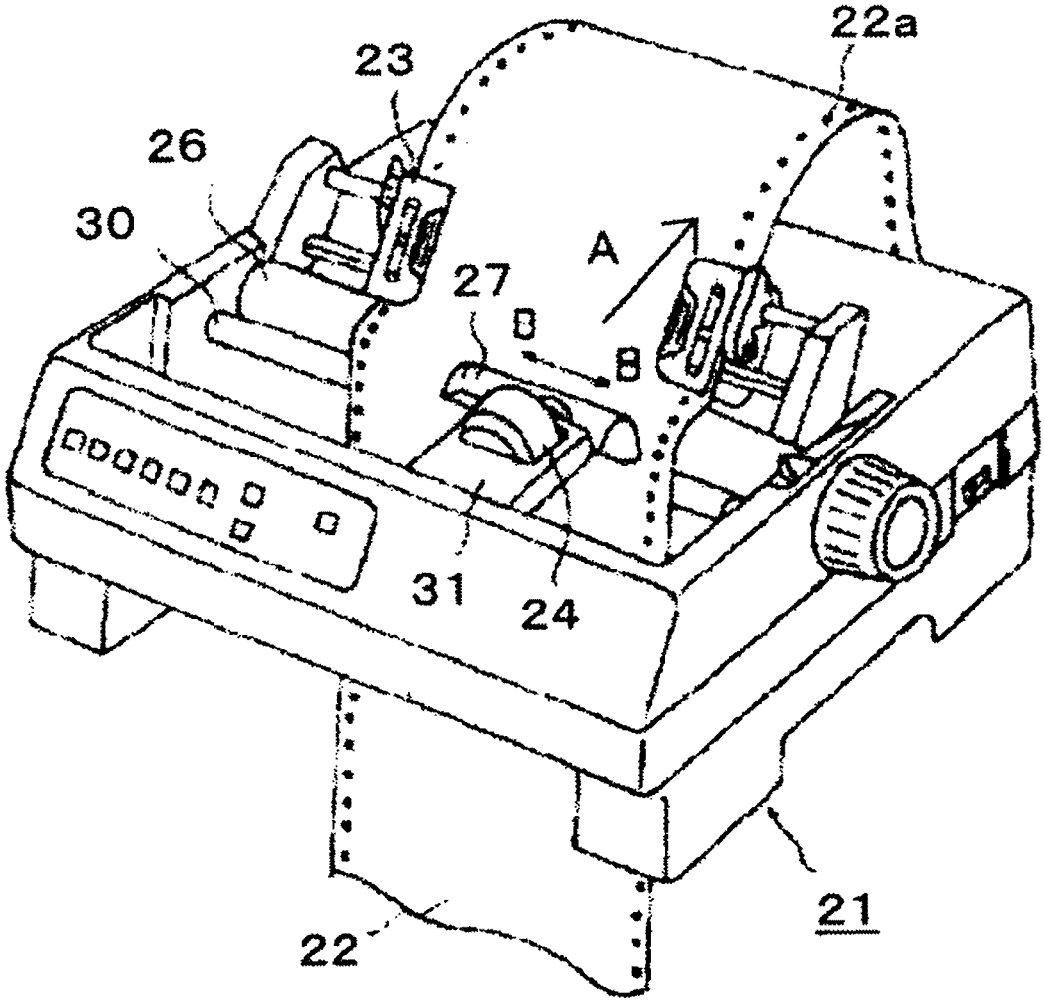
FIG. 19 is a perspective view showing a printing apparatus according to the present invention.

FIG. 19 is a perspective view showing a printing apparatus 21 according to the present invention. The printing apparatus 21 is a bottom-pull type, in which a pull-tractor 23 pulls a sprocket sheet 22 as a medium, and an impact head 24 prints on the sprocket sheet 22. FIG. 20 is a view showing a configuration around the impact head 24 of the printing apparatus 21 according to the present invention.

Figure 20:
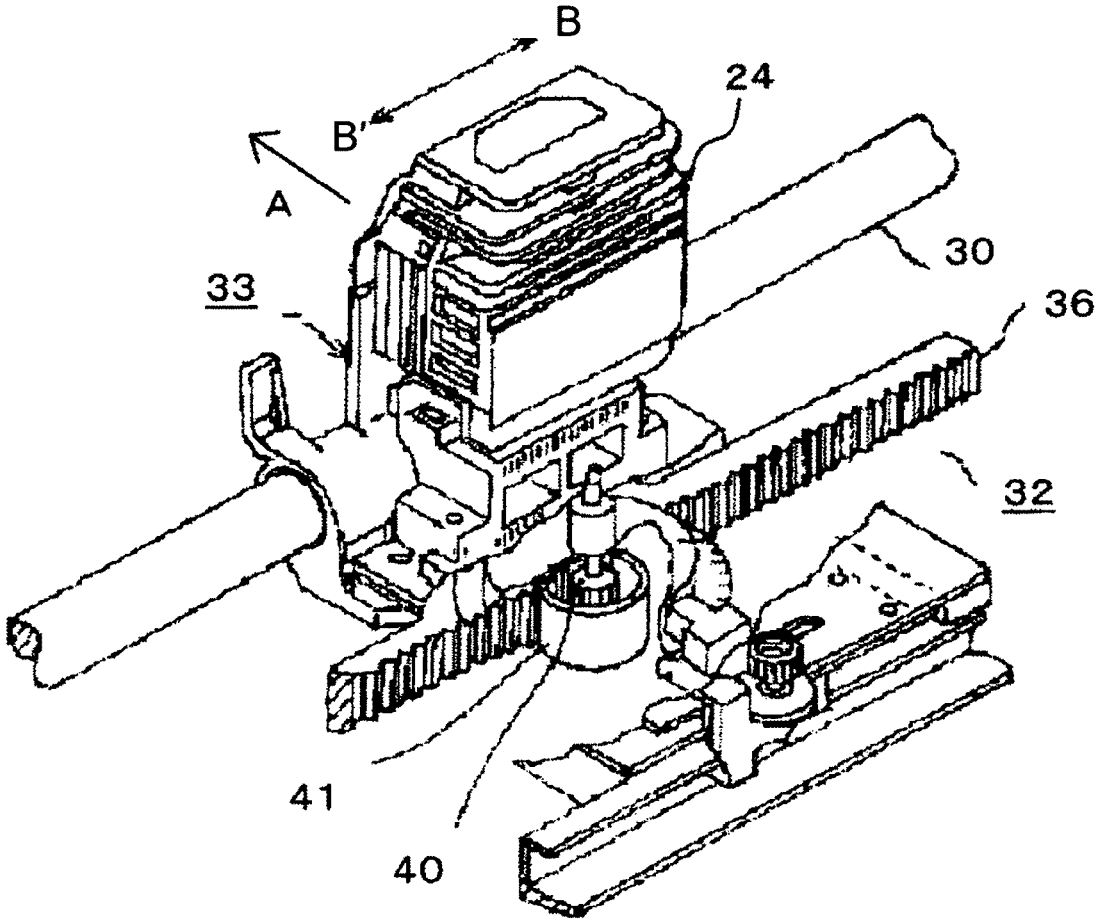
FIG. 20 is a view showing a configuration around an impact head of the printing apparatus according to the present invention.

As shown in FIGS. 19 and 20, a carriage mechanism 32 is provided for moving the impact head 24 along a platen 26 in an axial direction thereof. The carriage mechanism 32 is formed of a pinion 40; a rack 36 for engaging the pinion 40; a guide shaft 30 disposed to extend in parallel to the platen 26 and the rack 36; and a carriage 33 for mounting the impact head 24 thereon.

In the embodiment, the carriage 33 is attached to the guide shaft 30 to be slidable thereon. When the pinion 40 engaging the rack 36 rotates, the carriage 33 moves along the platen 26 in the axial direction thereof. The impact head 24 is driven in synchronizing with the movement of the carriage 33, so that the impact head 24 prints on the sprocket sheet 22 around the platen 26.

More specifically, the carriage 33 with the impact head 24 mounted thereon slides along the guide shaft 30 extending in parallel to the platen 26, so that the impact head 24 moves in an arrow direction B'-B. In synchronizing with the movement of the impact head 24, a plurality of wires is driven in an arrow direction A to impact the sprocket sheet 22 through an ink ribbon (not shown) retained in an ink ribbon cassette 31, thereby printing on the sprocket sheet 22.

Figure 2:
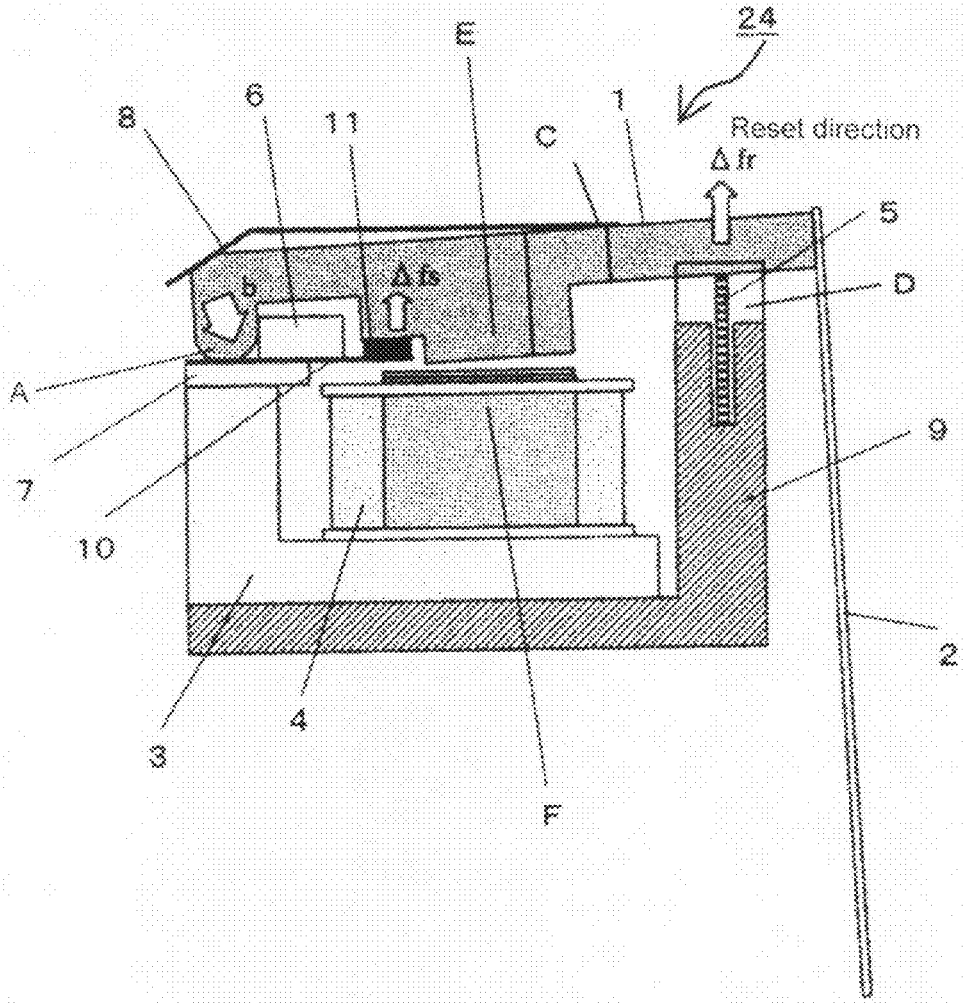
FIG. 2 is a schematic side view showing the impact head according to the first embodiment of the present invention.

A configuration of the impact head 24 will be explained next. FIG. 1 is a schematic perspective view showing the impact head 24 according to the first embodiment of the present invention. FIG. 2 is a schematic side view showing the impact head 24 according to the first embodiment of the present invention. FIGS. 1 and 2 show a configuration of the impact head 24 corresponding to a one-pin head. In a case of a 24-pin head, the configuration shown in FIGS. 1 and 2 is arranged on 24 locations in a circular shape.

As shown in FIGS. 1 and 2, the impact head 24 includes a core 3 formed of a magnetic material. An armature york 6 and a core york 7 are laminated and fixed on an outer circumference of the core 3. Further, the core 3 includes a protruding portion F for attracting an armature 1. The armature 1 includes a protruding portion E at a lower portion thereof to face the protruding portion F of the core 3. A coil 4 is disposed around the protruding portion F of the core 3, and a control unit (not shown) applies a current to the coil 4.

In the embodiment, a wire 2 is fixed to a distal end portion of the armature 1 through welding and the likes. A circular portion A is formed at a rear end portion of the armature 1 as a rotational pivot thereof. A spring plate 8 formed of an elastic member such as a leaf spring urges the armature 1 at a rear end portion thereof. Accordingly, the circular portion A formed at the rear end portion of the armature 1 is pressed against the armature york 6 and the core york 7 in an arrow direction b, thereby functioning as the rotational pivot of the armature 1.

In the embodiment, the spring plate 8 is fixed to a side of a head cover (not shown). A groove portion D is formed in a guide holder 9 for guiding the distal end portion of the armature 1 in the left to right direction to be movable in the vertical direction. A reset spring 5 is disposed in a hole formed in a bottom surface of the groove portion D of the guide holder 9. The reset spring 5 is formed of an urging member such as a coil spring. When the armature 1 is set in the groove portion D of the guide holder 9, the reset spring 5 lifts the armature 1 toward an upper surface of the core 3 (in a reset direction).

In the embodiment, the impact head 24 further includes a sub-spring 10 formed of an urging member such as a leaf spring with a magnetic property. An outer circumference of the sub-spring 10 is fixed with the armature york 6 or the core york 7. It may be configured such that the outer circumference of the sub-spring 10 is fixed with both the armature york 6 and the core york 7.

In the embodiment, an inner circumference of the sub-spring 10 is formed in a tongue shape, and each of the tongue shape is arrange to face the armature 1. A small piece 11 is disposed at a distal end portion of the tongue shape portion of the sub-spring 10 for lifting a lower portion of the armature 1. The distal end portion of the tongue shape portion of the sub-spring 10 is situated at a position facing the protruding portion F of the core 3.

In the embodiment, the sub-spring 10 has an urging force Δfs smaller than an urging force Δfr of the reset spring 5 (Δfs>Δfr). When a current is applied to the coil 4 to generate a magnetic flux, the protruding portion F of the core 3, the core 3, the core york 7, the sub-spring 10, the circular portion A of the armature 1, and the protruding portion E of the armature 1 constitute a first magnetic circuit. Further, when a current is applied to the coil 4 to generate a magnetic flux, the protruding portion F of the core 3, the core 3, the core york 7, and the sub-spring 10 constitute a second magnetic circuit.

In the embodiment, the small piece 11 is arranged to abut against the lower portion of the armature 1 upon resetting. Accordingly, it is preferred that the small piece 11 is formed of a non-magnetic material with a vibration absorbing property such a resin material as polyacetal (POM) and 66-nylon (PA66) containing 10% of glass beads or glass fibers.

Figure 3:
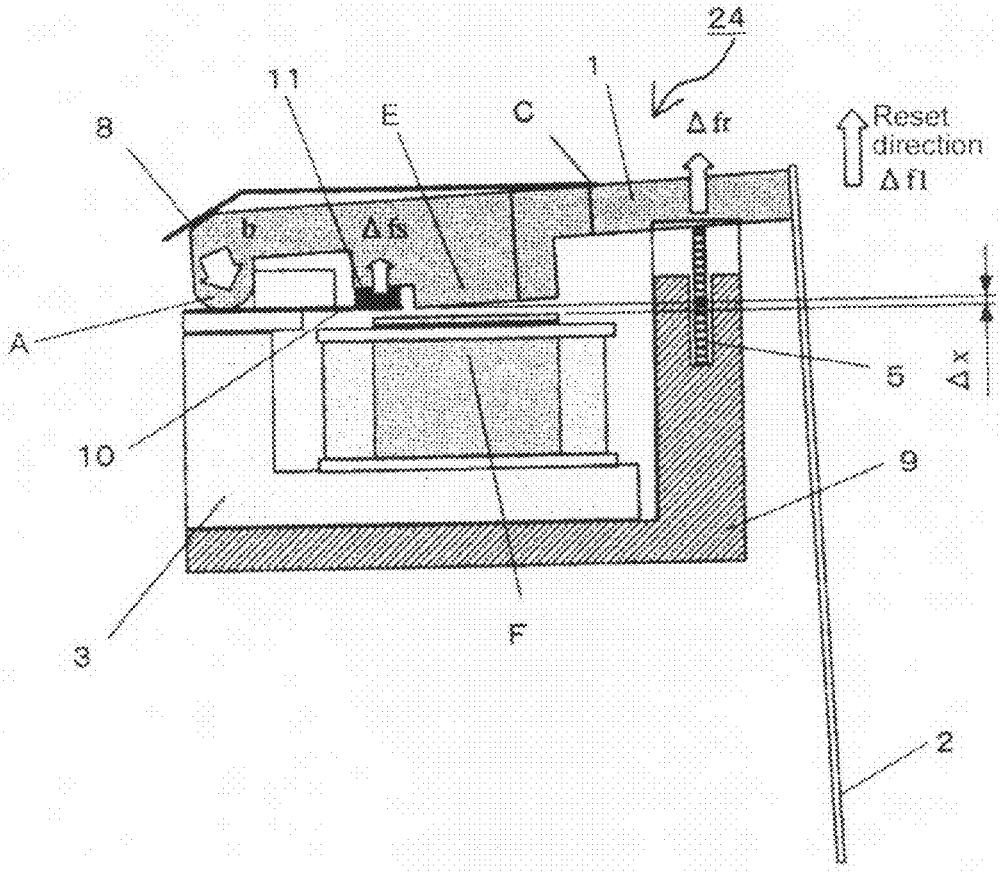
FIG. 3 is a schematic side view No. 1 showing an operation of the impact head according to the first embodiment of the present invention.
Figure 4:
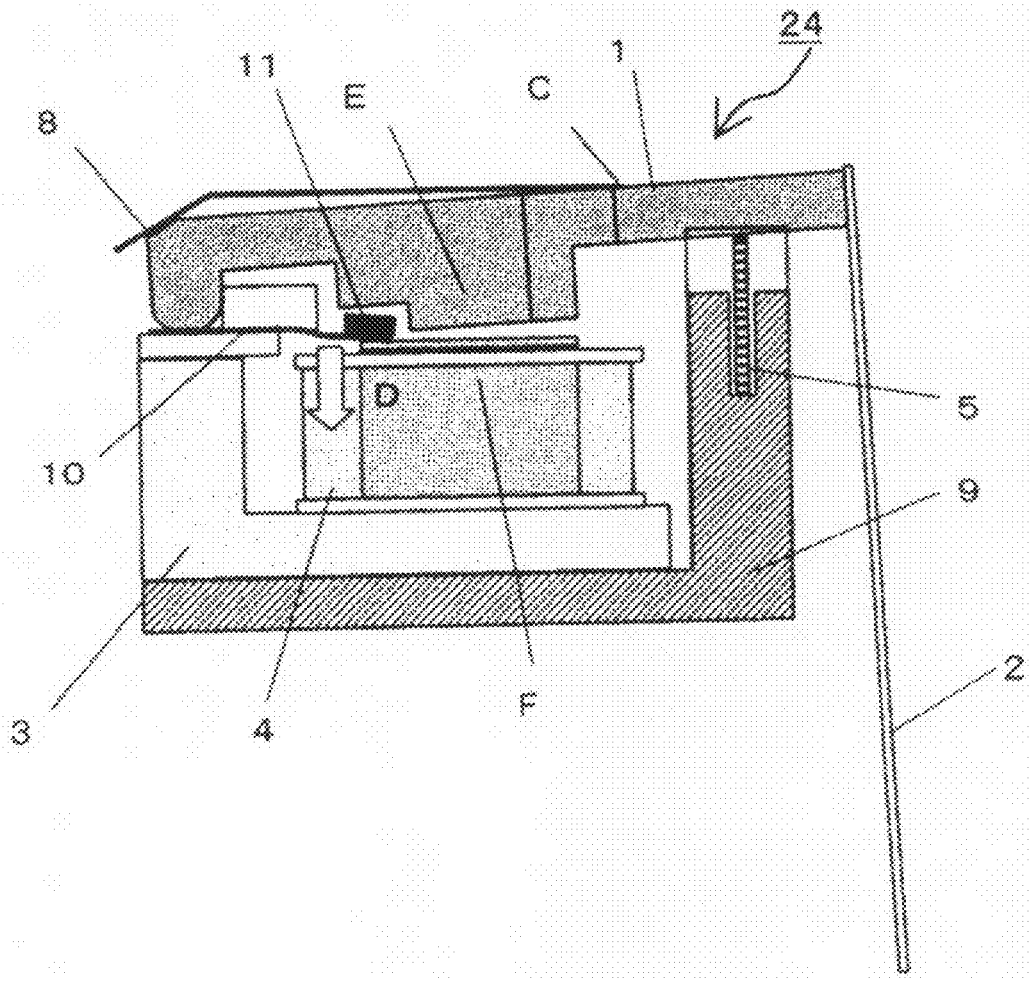
FIG. 4 is a schematic side view No. 2 showing the operation of the impact head according to the first embodiment of the present invention.
Figure 5:
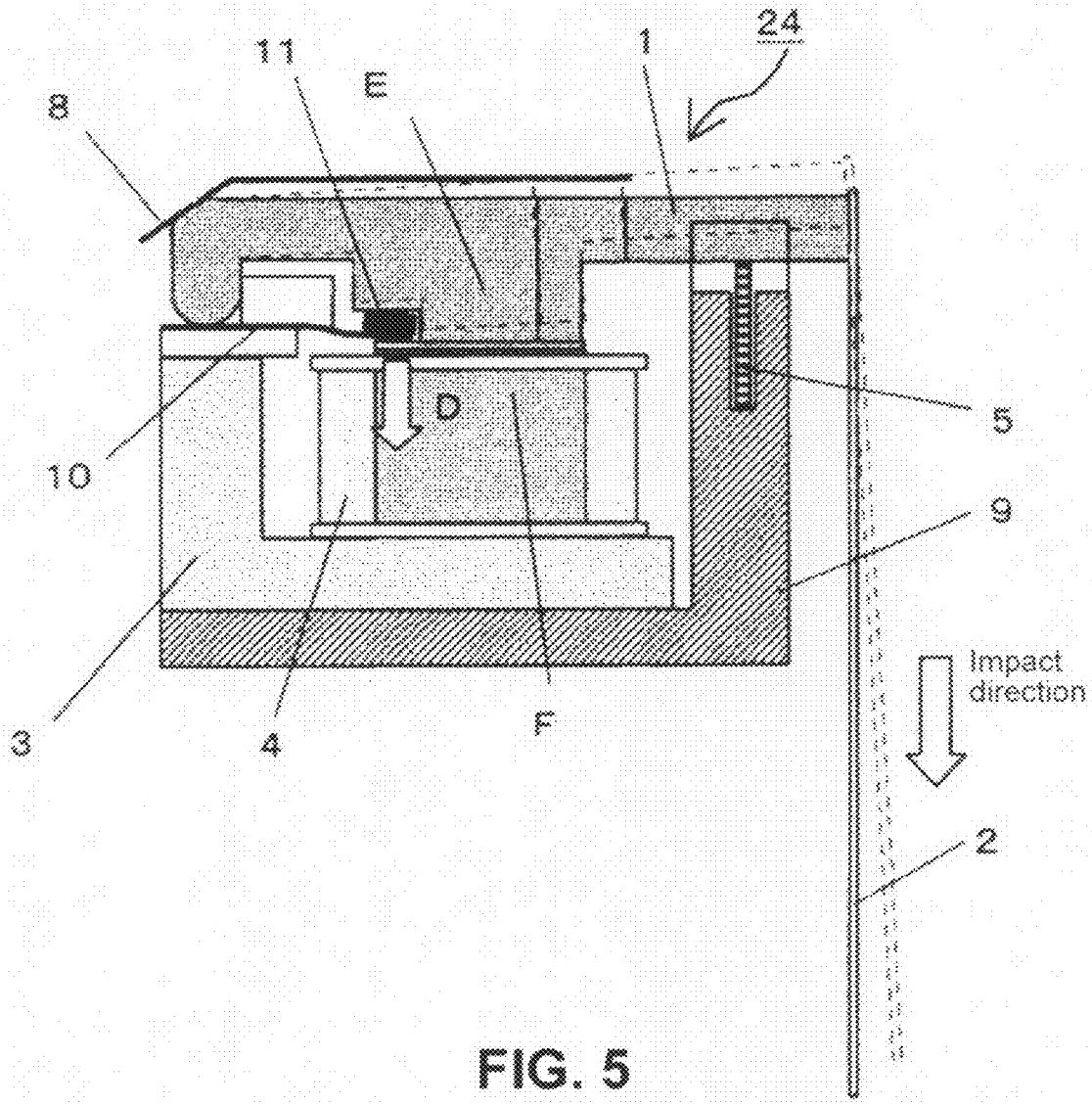
FIG. 5 is a schematic side view No. 3 showing the operation of the impact head according to the first embodiment of the present invention.

An operation of the impact head 24 will be explained next with reference to FIGS. 3 to 5. In the embodiment, it is configured that the armature 1 moves toward a bottom surface of the core 3 (in an impact direction) against the urging force of the reset spring 5, thereby applying an impact. FIG. 3 is a schematic side view No. 1 showing the operation of the impact head 24 according to the first embodiment of the present invention. FIG. 4 is a schematic side view No. 2 showing the operation of the impact head 24 according to the first embodiment of the present invention. FIG. 5 is a schematic side view No. 3 showing the operation of the impact head 24 according to the first embodiment of the present invention.

More specifically, FIG. 3 is a view showing a reset state of the impact head 24. FIG. 4 is a view showing a transitional state of the impact head 24 from the reset state to an impact state. FIG. 5 is a view showing the impact state of the impact head 24.

As shown in FIG. 3, in the reset state, the armature 1 is pressed with the spring plate 8 in an arrow direction b with the circular portion A of the armature 1 as the rotational pivot. The reset spring 5 urges the armature 1 with the urging force Δfr in the reset direction. Further, the sub-spring 10 urges the armature 1 with the urging force Δfs through the small piece 11 in the reset direction.

In the embodiment, the spring plate 8 has a portion C for restricting the armature 1 urged by the reset spring 5 and the sub-spring 10 from rising. Accordingly, the protruding portion E of the armature 1 is separated from the protruding portion F of the core 3 by a distance Δx.

At this moment, as described above, the sub-spring 10 lifts the armature 1 with the urging force Δfs in the reset direction. Accordingly, the lower portion of the sub-spring 10 is separated from the protruding portion F of the core 3 by the distance Δx as well.

When the control unit (not shown) supplies a current to the coil 4 to generate a magnetic flux, the impact head 24 becomes the transition state shown in FIG. 4. As described above, it is configured that the sub-spring 10 has the urging force Δfs smaller than the urging force Δfr of the reset spring 5 (Δfs<Δfr). Accordingly, when the magnetic flux is generated, first, the sub-spring 10 with the smaller urging force is attracted to the protruding portion F of the core 3 in an arrow direction D.

Then, the armature 1 is attracted in the impact direction against the urging force Δfr of the reset spring 5, thereby becoming the impact state shown in FIG. 5. Accordingly, the wire 2 at the distal end portion of the armature 1 moves with the circular portion A as the rotational pivot, thereby applying an impact.

After applying the impact, when the control unit stops supplying the current to the coil 4, the magnetic flux disappears. Accordingly, the sub-spring 10 moves away from the core 3 and lifts the armature 1 with the urging force Δfs thereof. Further, the reset spring 5 lifts the armature 1 with the urging force Δfr thereof, so that the armature 1 returns to the reset state with a combinational force of the urging force Δfs and the urging force Δfr.

Figure 6:
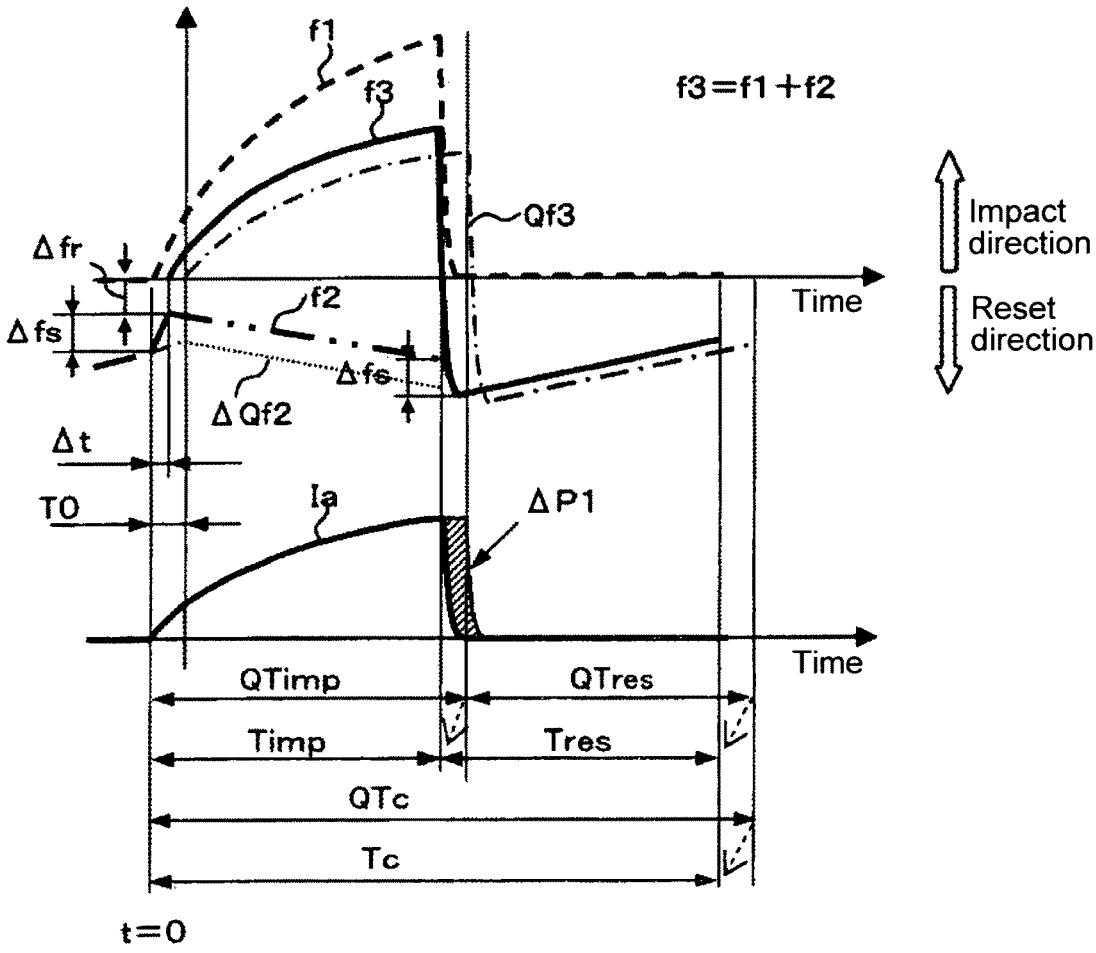
FIG. 6 is a graph showing a current applied to the impact head and an armature force of the impact head according to the first embodiment of the present invention.

FIG. 6 is a graph showing a current Ia applied to the coil 4 of the armature 1 of the impact head 24 and an armature force of the impact head 24 according to the first embodiment of the present invention. As shown in FIG. 6, the current Ia is applied to the coil 4 at a timing (t=0), and is turned off when the wire 2 reaches an impact point. When the current Ia is applied, the armature force f1 is generated for attracting the armature 1 in the impact direction. An urging force f2 is applied to the armature 1 with the reset spring 5 and the sub-spring 10 in the reset direction, and a combinational force f3 is a combinational force of the armature force f1 and the urging force f2.

Note that, in FIG. 6, the drive force Qf3 of the conventional impact head 24' (without the sub-spring 10) is represented with a hidden line, and the reset spring 5' of the conventional impact head 24' has the urging force Qf2 represented with a hidden line.

In the reset state shown in FIG. 3, the reset spring 5 and the sub-spring 10 urge the armature 1 with the urging force f2 (Δfs+Δfr) in the reset direction. When the current Ia is applied to the coil 4 for the impact operation, the armature force f1 is generated to move the armature 1 in the impact direction.

As described above, it is configured that the sub-spring 10 has the urging force Δfs smaller than the urging force Δfr of the reset spring 5 (Δfs<Δfr). Accordingly, from the timing (t=0) to a timing (t=Δt), before the armature 1 is attracted to move, the sub-spring 10 with the smaller urging force is attracted to the protruding portion F of the core 3 as shown in FIG. 4. During the period of time, the combinational force f2 in the reset direction decreases by Δfs corresponding to the urging force of the sub-spring 10, and changes as shown in FIG. 6.

In the conventional impact head 24' without the sub-spring 10, after the period of time T0, the combinational force f3 is generated to move the armature 1'. In the embodiment, with the sub-spring 10, after the period of time Δt, the combinational force f3 is generated to move the armature 1. When an impact time Timp passes after the current Ia is applied at the timing (t=0), the impact head 24 becomes the impact state as shown in FIG. 5.

When the wire 2 reaches the impact position and the current Ia is turned off, the armature force f1 disappears. At the same time, the sub-spring 10 stops urging and the urging force Δfs is generated. Accordingly, the armature 1 returns in the reset direction with the combinational force f2 of the urging force Δfr of the reset spring 5 and the urging force Δfs of the sub-spring 10. When a reset time QTres passes after the current Ia is turned off, the armature 1 returns to the reset state shown in FIG. 3.

As described above, in the embodiment, the small piece 11 is formed of the non-magnetic material with a vibration absorbing property. Accordingly, when the sub-spring 10 returns to the original shape to abut against the armature 1, it is possible to reduce a noise.

As described above, in the embodiment, the sub-spring 10 is provided in the impact head 24. Accordingly, when the current is turned on, the armature 1 quickly performs the impact operation and the impact time Timp decreases. When the current is turned off, the armature 1 quickly returns to the reset state, and the reset time Tres decreases. As a result, when the impact time QTimp and the reset time QTres represent a cycle time QTc, it is possible to shorten the cycle time QTc.

In the embodiment, it is configured that the sub-spring 10 functions as an auxiliary member for retuning the armature 1 to the reset state, thereby preserving energy corresponding to a current ΔP1 shown as a hatched portion in FIG. 6. The energy preservation is effective to each pin, thereby greatly decreasing total energy consumption in an actual printing operation.

As described above, in the printing apparatus in the first embodiment, the impact head 24 is configured such that the armature 1 or an arm member is driven toward the protruding portion of the core 3, and the reset spring 5 returns the arm member to the reset state. The small piece 11 formed of the non-magnetic material is disposed at the position away from the protruding portion of the core 3. Further, the sub-spring 10 is provided for urging the arm member away from the protruding portion of the core 3. Accordingly, it is possible to shorten the impact time and the reset time, thereby shortening the cycle time and increasing the print speed. Further, the sub-spring 10 functions as the auxiliary member for retuning the armature 1 to the reset state, thereby reducing energy consumption.

Second Embodiment

Figure 7:
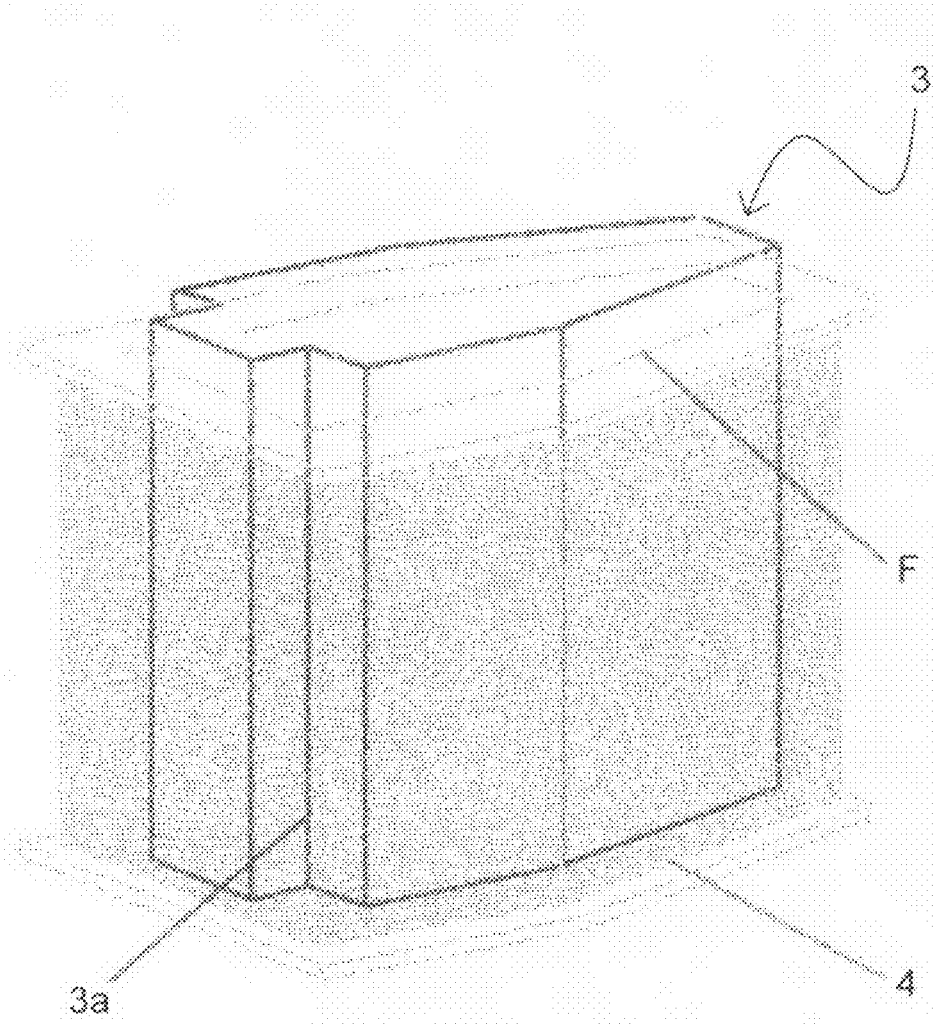
FIG. 7 is an enlarged perspective view showing a core of an impact head according to a second embodiment of the present invention.
Figure 8:
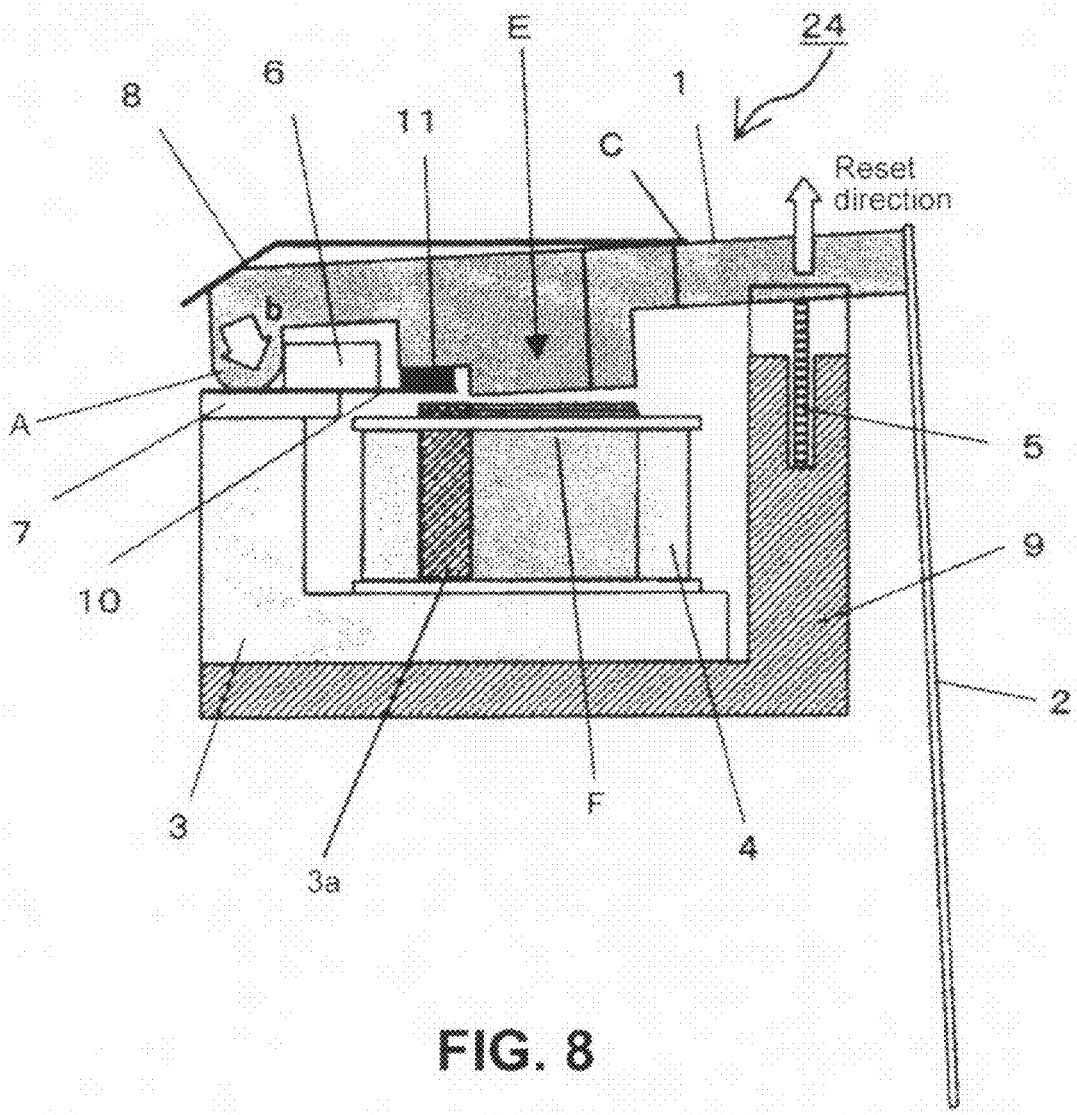
FIG. 8 is a schematic side view showing the impact head according to the second embodiment of the present invention.

A second embodiment of the present invention will be explained next. FIG. 7 is an enlarged perspective view showing the protruding portion F of the core 3 of the impact head 24 according to the second embodiment of the present invention. FIG. 8 is a schematic side view showing the impact head 24 according to the second embodiment of the present invention.

As shown in FIG. 7, the protruding portion F of the core 3 is provided with a step portion 3*a* at a position near the small piece 11 of the sub-spring 10. Further, the sub-spring 10 has an urging force larger than that in the first embodiment. Other components in the second embodiment are similar to those in the first embodiment, and explanations thereof are omitted.

An operation of the impact head 24 will be explained next. As described above, in the second embodiment, the protruding portion F of the core 3 is provided with the step portion 3*a* at the position near the small piece 11 of the sub-spring 10. Accordingly, when a same current is applied, it is possible to quickly increase a magnetic flux of the step portion 3*a*.

In general, an attraction force F of a coil is expressed as follows:

$$F=B^2\times S/2\mu 0$$

where B is a magnetic flux density, S is a sectional area of the core, and μ0 is a magnetic permeability. Further, the magnetic flux density B is expressed as follows:

$$B=\Phi/S$$

where Φ is a magnetic flux.

From the above equations, the attraction force F is expressed as follows:

$$F=\Phi^2(2\mu 0\times S)$$

The magnetic flux Φ and the magnetic permeability μ0 are constant values, so that the attraction force F is disproportional to the sectional area S of the core.

As compared with the protruding portion F of the core 3 in the first embodiment, in the impact head 24 in the second embodiment, the protruding portion F of the core 3 has a smaller sectional area. Accordingly, the attraction force F increases disproportionally, thereby attracting the sub-spring 10 quicker.

Figure 9:
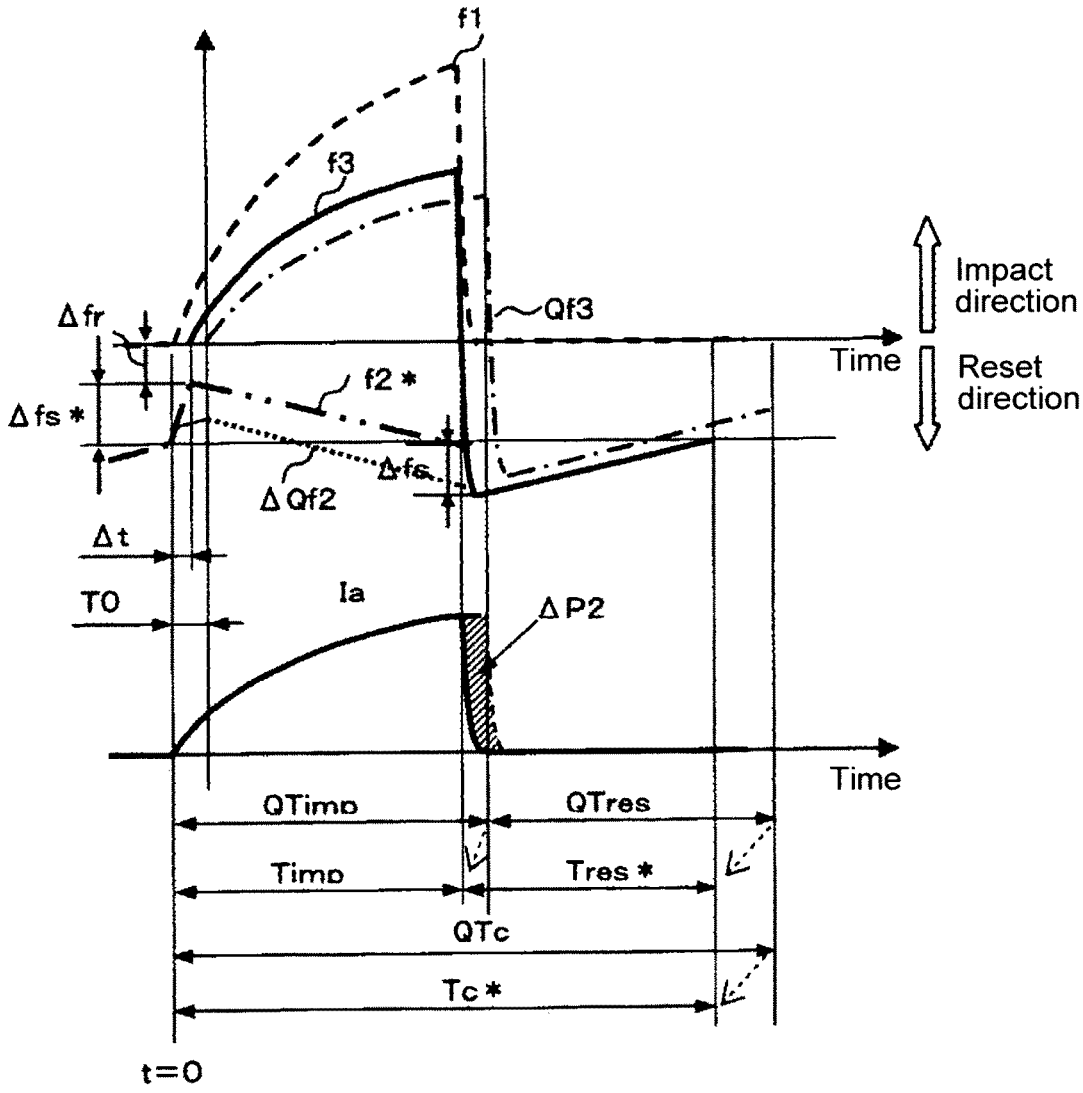
FIG. 9 is a graph showing a current applied to the impact head and an armature force of the impact head according to the second embodiment of the present invention.

FIG. 9 is a graph showing the current Ia applied to the impact head 24 and the armature force of the impact head 24 according to the second embodiment of the present invention.

In the embodiment, as shown in FIG. 9, it is possible to quickly attract the sub-spring 10 during a period of time (t=Δt) from when the armature 1 starts moving in the impact direction upon applying the current. As compared with the urging force Δfs of the sub-spring 10 in the first embodiment, it is possible to increase the urging force Δfs* of the sub-spring 10 during the period of time Δt.

Accordingly, in the impact state, it is possible to apply the impact in a period of time smaller than the impact time QTimp of the conventional impact head. Further, after an impact time Timp, the armature 1 returns to the reset state with a combinational force f2* of the urging force Δfs* of the sub-spring 10 and the urging force Δfr of the reset spring 5. Accordingly, it is possible to return the armature 1 to the reset state in a reset time Tres* shorter than the reset time Tres in the first embodiment, that is improved from the reset time QTres of the conventional impact head. As a result, when the impact time Timp and the reset time Tres* represent a cycle time Tc*, it is possible to further shorten the cycle time Tc*.

In the embodiment, it is configured that the sub-spring 10 functions as an auxiliary member for retuning the armature 1 to the reset state, thereby preserving energy corresponding to a current ΔP2 shown as a hatched portion in FIG. 9. As compared with the first embodiment, the urging force Δfs* of the sub-spring 10 is greater, thereby preserving energy corresponding to the current ΔP2 larger than that in the first embodiment. Similar to the first embodiment, the energy preservation is effective to each pin, thereby greatly decreasing total energy consumption in an actual printing operation.

As described above, in the embodiment, the protruding portion F of the core 3 is provided with the step portion 3*a*. Further, the sub-spring 10 has the urging force larger than that in the first embodiment. Alternatively, the sub-spring 10 may have the urging force the same as that in the first embodiment. In this case, the reset time Tres* becomes the same as the reset time Tres in the first embodiment. However, the protruding portion F of the core 3 is provided with the step portion 3*a*, so that the magnetic flux increases more quickly. Accordingly, it is possible to shorten the period of time Δt from when the armature 1 starts moving in the impact direction at the timing (t=0).

As described above, in the embodiment, the protruding portion F of the core 3 is provided with the step portion 3*a* at the position facing the small-piece 11 of the sub-spring 10, so that the magnetic flux increases more quickly. Further, the sub-spring 10 has the urging force larger than that in the first embodiment. Accordingly, it is possible to further shorten the reset time Tres*, thereby decreasing the cycle time Tc* and the print speed.

Further, it is configured that the sub-spring 10 functions as the auxiliary member for retuning the armature 1 to the reset state with the larger urging force, thereby further reducing energy consumption.

Third Embodiment

Figure 10:
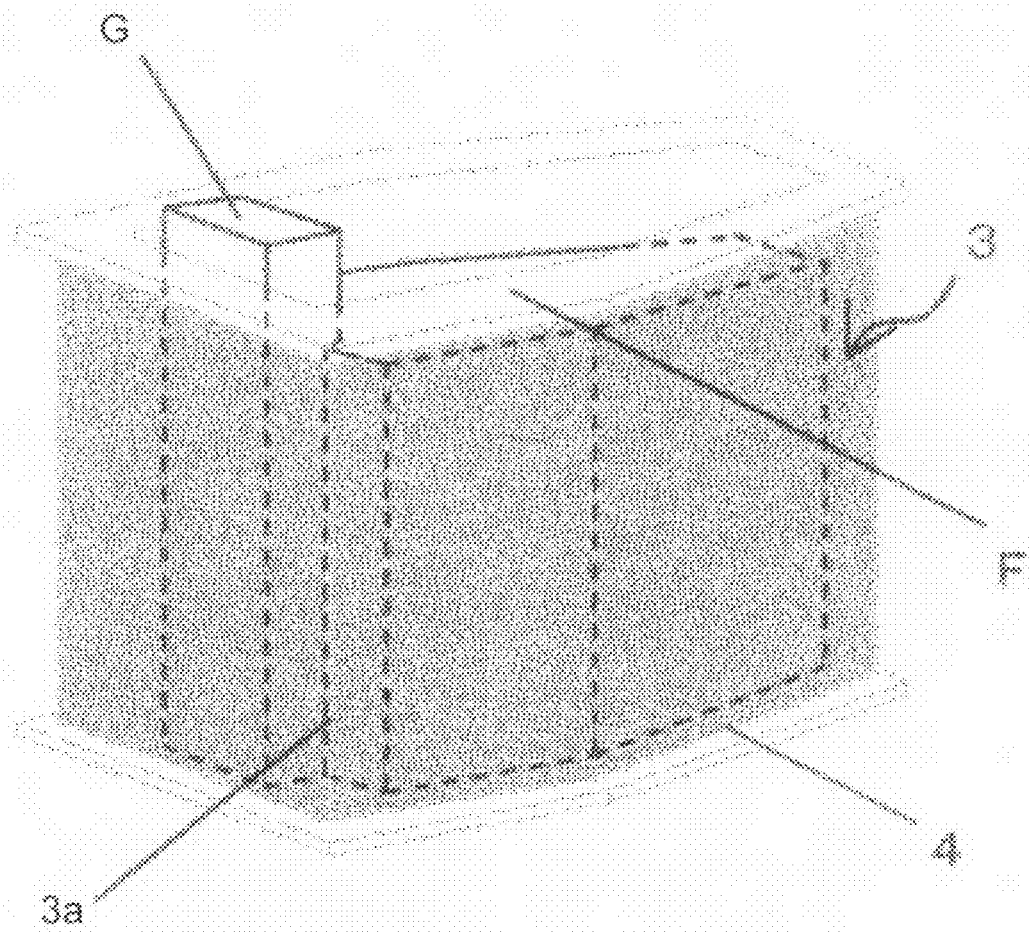
FIG. 10 is an enlarged perspective view showing a core of an impact head according to a third embodiment of the present invention.
Figure 11:
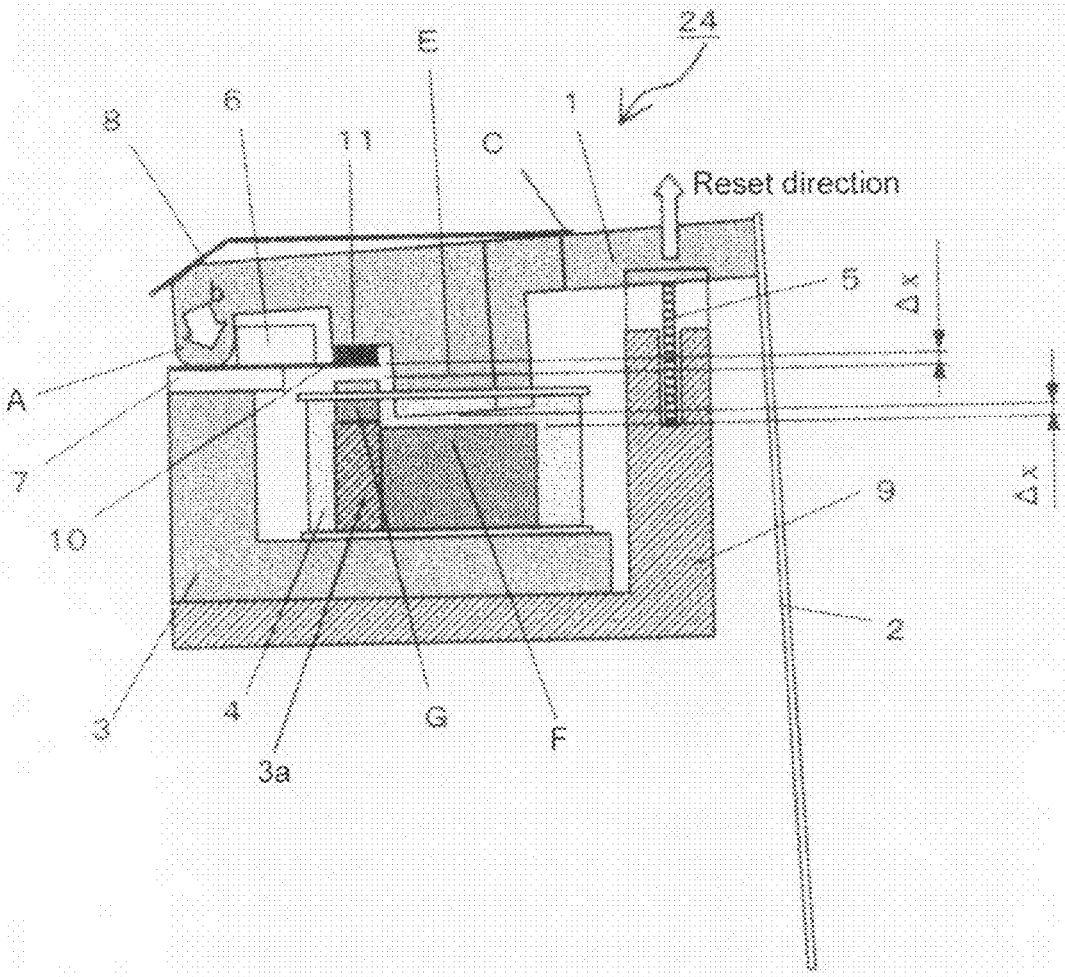
FIG. 11 is a schematic side view showing the impact head according to the third embodiment of the present invention.

A third embodiment of the present invention will be explained next. FIG. 10 is an enlarged perspective view showing the core 3 of the impact head 24 according to the third embodiment of the present invention. FIG. 11 is a schematic side view showing the impact head 24 according to the third embodiment of the present invention.

As shown in FIG. 10, the protruding portion F of the core 3 is provided with the step portion 3*a* and a protruding portion G (a second opposite surface) at a position near the small piece 11 of the sub-spring 10. Further, the protruding portion F of the core 3 has a first opposite surface facing the protruding portion E of the armature 1, and the first opposite surface is situated at a level lower than an upper surface of the coil 4.

As shown in FIG. 11, the protruding portion E of the armature 1 is configured such that the first opposite surface of the protruding portion F of the core 3 is away from the protruding portion E of the armature 1 by a distance Δx in the reset state. Further, the protruding portion G of the core 3 is configured such that a lower surface of the small piece 11 of the sub-spring 10 is away from the protruding portion G of the core 3 by a distance Δx in the reset state. Other components in the third embodiment are similar to those in the second embodiment, and explanations thereof are omitted.

An operation of the impact head 24 will be explained next. As described above, the protruding portion F of the core 3 has the first opposite surface facing the protruding portion E of the armature 1, and the first opposite surface is situated at the level lower than the upper surface of the coil 4. Accordingly, the protruding portion F of the core 3 faces the protruding portion E of the armature 1 inside the coil 4. At this moment, the protruding portion F of the core 3 is provided with the protruding portion G at the position near the small piece 11 of the sub-spring 10, thereby having a positional relationship similar to those in the first and second embodiments.

Accordingly, it is possible to stably generate a strong magnetic flux. When the current Ia is supplied, it is possible to generate the attraction force f1 with a high level for attracting the armature 1 in the impact direction, and further to quickly rise the magnetic flux in the protruding portion G. More specifically, it is possible to shorten the impact time Timp with the attraction force f1 with the high level, and further to shorten the reset time with the urging force of the sub-spring 10 in the reset state, similar to the first and second embodiments.

As described above, in the embodiment, it is possible to increase the attraction force f1. Accordingly, when the urging force Δfr of the reset spring 5, i.e., the reaction force thereof, increases, and the combinational force f3 of the attraction forces f1 and f2 (=Δfs+Δfr) is set to be the same as the combinational force in the second embodiment, it is possible to further shorten the reset time Tres, as compared with those in the first and second embodiments.

In the third embodiment, similar to the second embodiment, the protruding portion F of the core 3 is provided with the step portion 3*a*. Alternatively, the protruding portion F of the core 3 may not be provided with the step portion 3*a*.

As described above, the protruding portion F of the core 3 is provided with the protruding portion G (the second opposite surface) at the position near the small piece 11 of the sub-spring 10. Further, the protruding portion F of the core 3 has the first opposite surface facing the protruding portion E of the armature 1, and the first opposite surface is situated at the level lower than an upper surface of the coil 4. Accordingly, it is possible to further shorten the reset time Tres, thereby decreasing the cycle time and the print speed.

Figure 12:
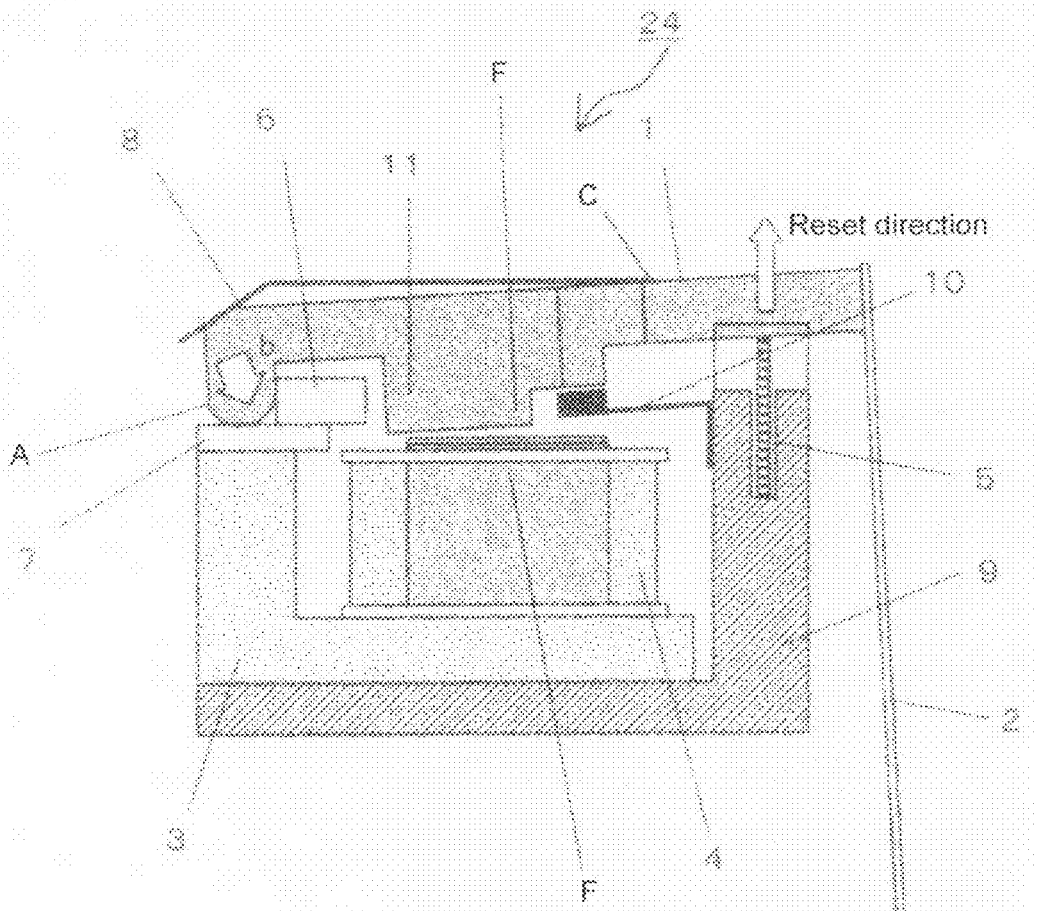
FIG. 12 is a schematic side view showing a modified example of the impact head according to the third embodiment of the present invention.
Figure 13:
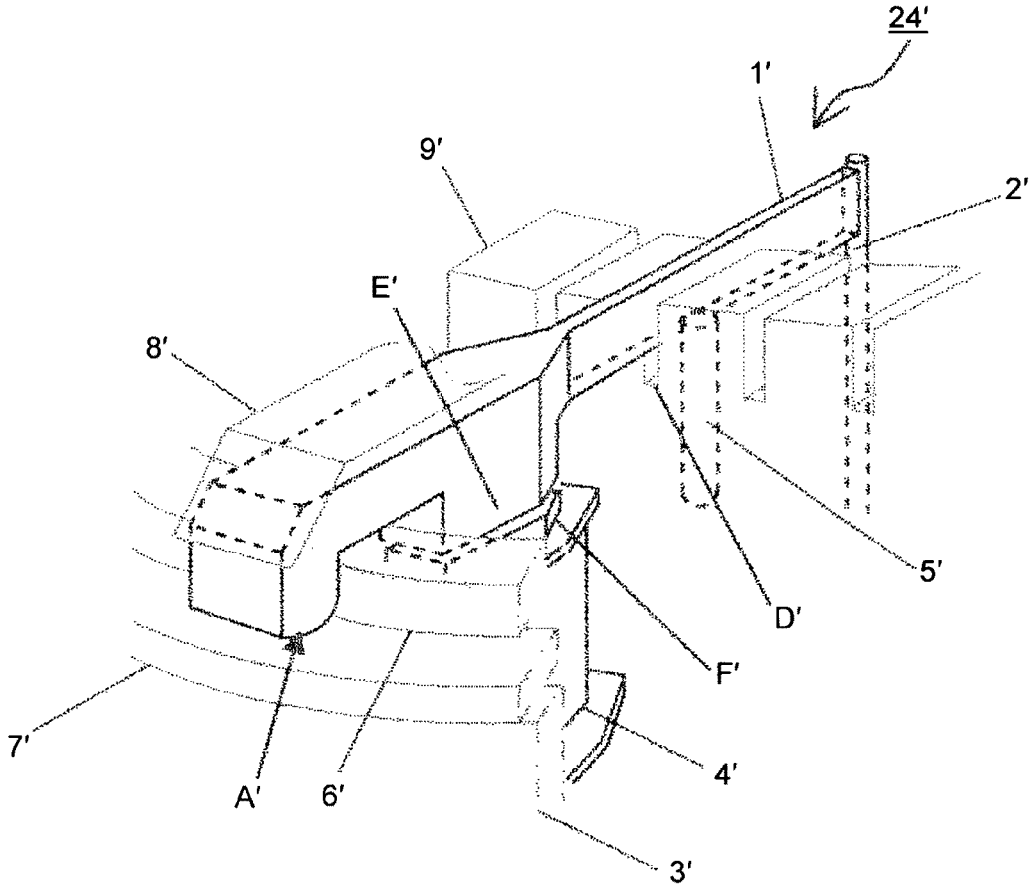
FIG. 13 CONVENTIONAL ART
FIG. 13 is a schematic perspective view showing a conventional impact head.
Figure 14:
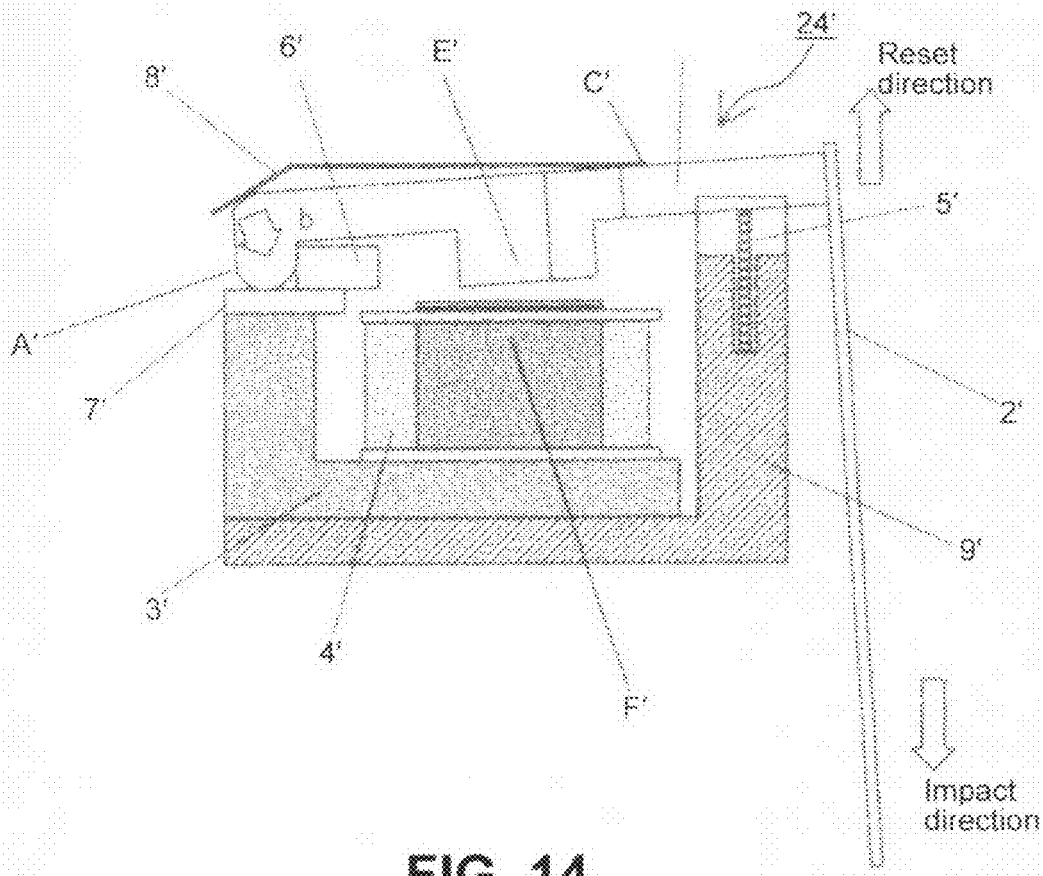
FIG. 14 CONVENTIONAL ART
FIG. 14 is a schematic side view showing the conventional impact head.
Figure 15:
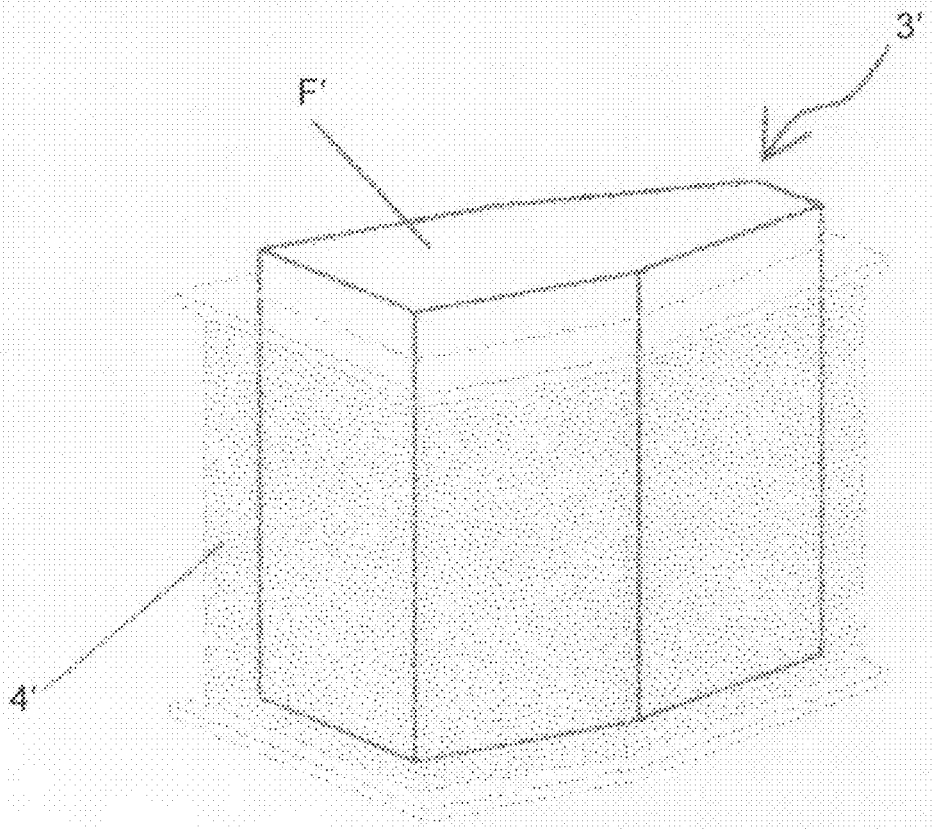
FIG. 15 CONVENTIONAL ART
FIG. 15 is an enlarged perspective view showing a core of the conventional impact head.
Figure 16:
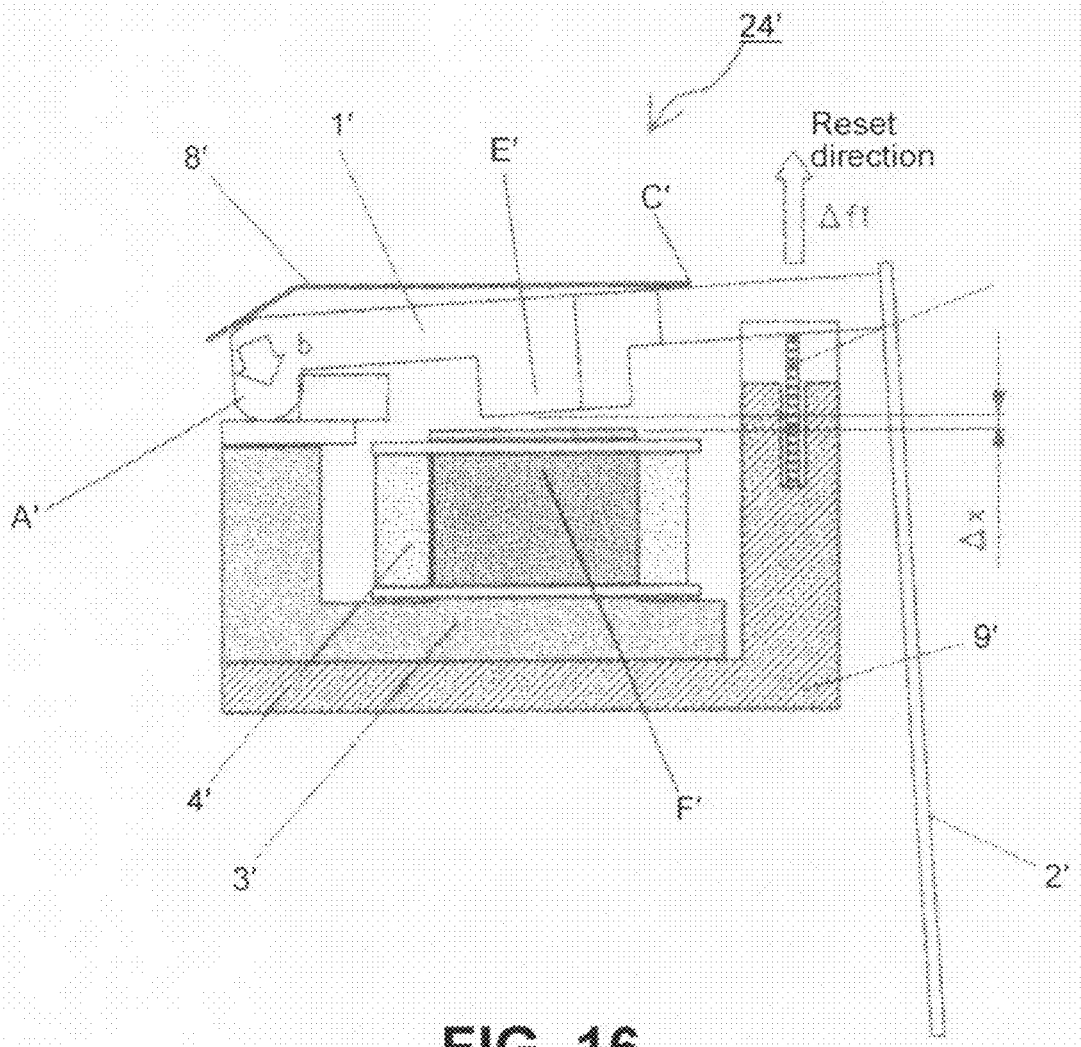
FIG. 16 CONVENTIONAL ART
FIG. 16 is a schematic view No. 1 showing an operation of the conventional impact head.
Figure 17:
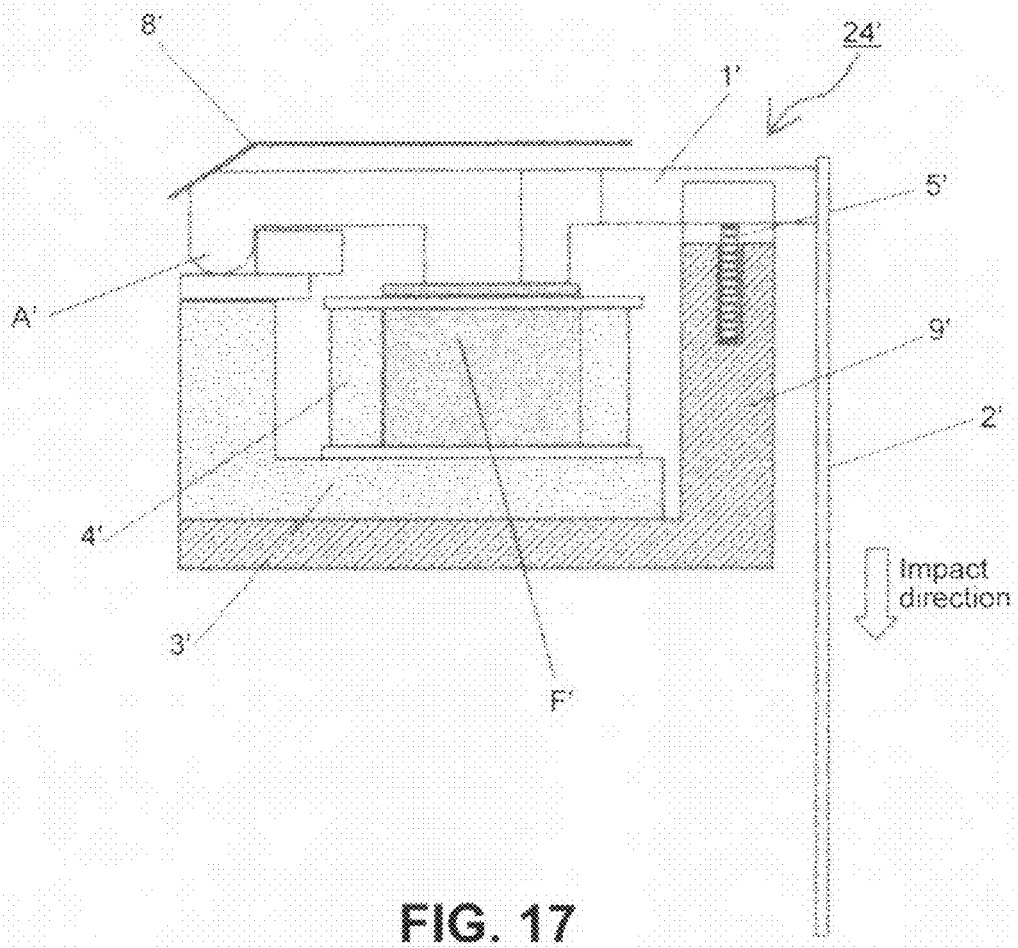
FIG. 17 CONVENTIONAL ART
FIG. 17 is a schematic view No. 2 showing the operation of the conventional impact head.
Figure 18:
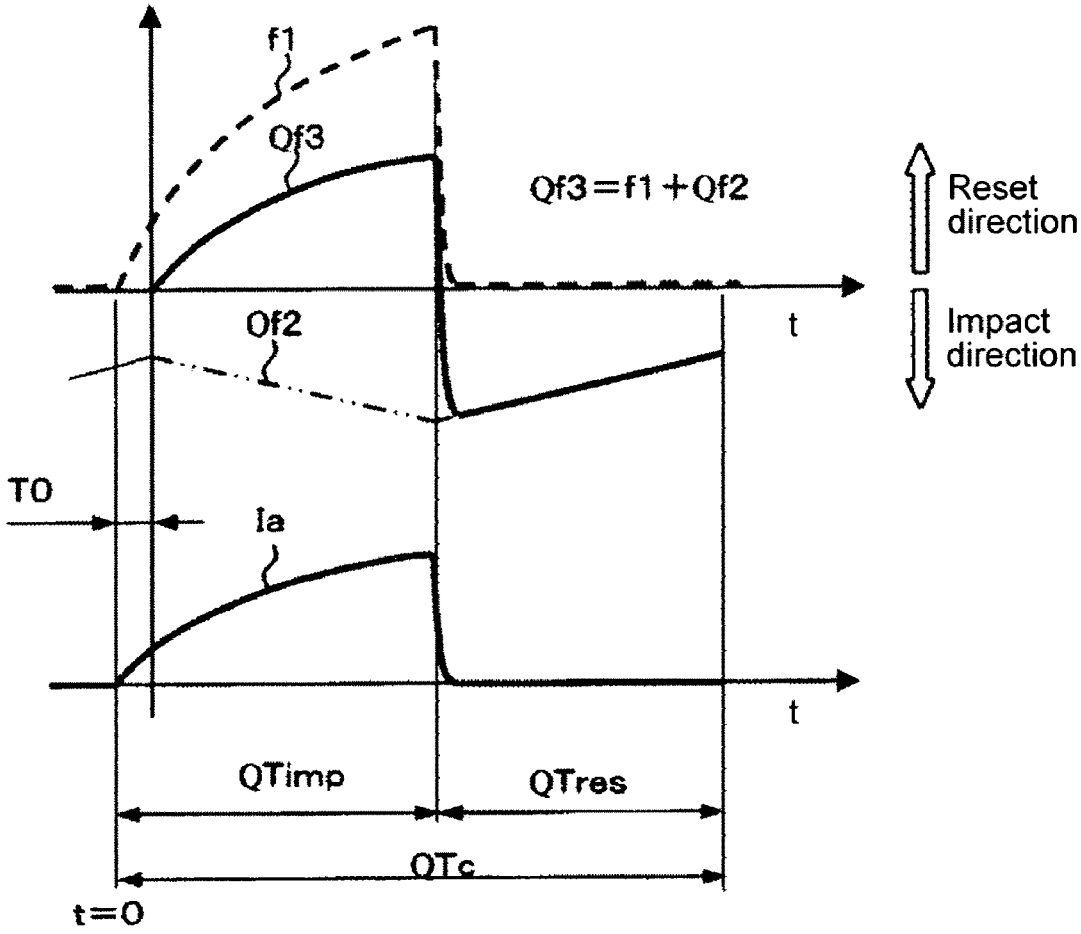
FIG. 18 CONVENTIONAL ART
FIG. 18 is a graph showing a current applied to the conventional impact head and an armature force of the conventional impact head.

In the embodiment described above, the armature york 6 and the core york 7 are laminated and fixed on the outer circumference of the sub-spring 10, and may be modified. FIG. 12 is a schematic side view showing a modified example of the impact head 24 according to the third embodiment of the present invention.

As shown in FIG. 12, the guide holder 9 is formed of a material capable of generating a magnetic flux, and the armature york 6 and the core york 7 are fixed to the guide holder 9. Accordingly, it is possible to increase a moment of the urging force of the sub-spring 10, thereby enhancing the effect of the sub-spring 10.

As described above, the present invention is applicable to the printing apparatus such as the impact printer provided with the impact head of the clapper type, in which the wire is driven through the magnetic flux.

The disclosure of Japanese Patent Application No. 2008-086481, filed on Mar. 28, 2008, is incorporated in the application by reference.

While the invention has been explained with reference to the specific embodiments of the invention, the explanation is illustrative and the invention is limited only by the appended claims.

What is claimed is:

1. An impact head, comprising:

an arm member moving to a protruding position when a magnetic flux is generated and to a return position when the magnetic flux disappears;

an impact member connected to the arm member for protruding when the arm member moves to the protruding position and returning to an original position when the arm member moves to the return position;

an urging member for urging the arm member to the return position; and a return urging member with spring property for urging the arm member to the return position all the time.

2. The impact head according to claim 1, wherein said urging member is formed of a spring member, said spring member including a small piece on a path of a magnetic flux, said small price being formed of a non-magnetic material.

3. The impact head according to claim 2, wherein said small price is partially or entirely formed of a non-magnetic material.

4. A printing apparatus comprising the impact head according to claim 1.

* * * * *